United States Patent [19]

Schnarr et al.

[11] 4,102,005

[45] Jul. 25, 1978

[54] DOOR CLOSER ARM

[75] Inventors: Raymond H. Schnarr, Princeton, Ill.; John P. Jester, Fort Washington, Pa.

[73] Assignee: Schlage Lock Company, San Francisco, Calif.

[21] Appl. No.: 813,091

[22] Filed: Jul. 5, 1977

[51] Int. Cl.[2] ..... E05E 3/00

[52] U.S. Cl. ..... 16/49; 16/82; 16/71

[58] Field of Search ..... 16/49, 51, 66, 70, 71, 16/80, 82, 83, 84

[56] References Cited

U.S. PATENT DOCUMENTS

| | | | |
|---|---|---|---|
| 2,932,846 | 4/1960 | Rolph | 16/51 X |
| 3,082,471 | 3/1963 | Rolph | 16/49 |
| 3,259,936 | 7/1966 | Sheridan | 16/85 X |
| 3,260,545 | 7/1966 | Check | 16/71 X |

*Primary Examiner*—Ronald Feldbaum

*Attorney, Agent, or Firm*—Lothrop & West

[57] ABSTRACT

A door closer and a connector are joined to a door panel and a door frame. The connector includes an arm and a restraining device such as a track or a link. The arm has an arm base fast on a shaft projecting from the closer for rotation about a first axis and has an arm extension at one end connected to the restraining device and at the other end pivoted to the arm base for rotation relative thereto about a second axis parallel to and spaced from the first axis. A shoulder on the arm base and an abutment on the arm extension come into contact in one position of relative rotation of the arm base and the arm extension. If desired, there may also be a locking device engaging both the arm base and the arm extension and precluding relative rotation therebetween about the second axis. Further, there may be a damping device such as a friction brake for partially inhibiting relative rotation about the second axis.

10 Claims, 5 Drawing Figures

DOOR CLOSER ARM

BRIEF SUMMARY OF THE INVENTION

A door closer usually of the spring-propelled, hydraulically restrained variety is mounted on a door frame or a door panel. The closer is joined to the other of the panel or frame by a connector including either a pair of arms or a single arm interengaged with a track. In either case, a projecting shaft of the door closer is rotated about a first axis when the door panel and the frame move with regard to each other. There is provided a restraining or "hold-open" device precluding closing operation of the closer and holding the door panel in open position. To allow manual swinging movement of the door panel without disturbing the hold-open function of the door closer, there is herein provided a two-part closer arm including an extra pivotal interconnection between a closer arm base and a closer arm extension allowing pivotal movement about a second axis parallel to the first axis. To limit this movement, a shoulder on the arm base can abut an abutment on the arm extension in one relative location of the arm base and arm extension. With this arrangement, the door panel can be held open by the hold-open device of the closer, but a person can still swing the door panel manually because of the relative rotation of the closer arm portions about the pivot on the second axis. Should the door panel be left in any intermediate position, the hold-open device, when released, permits the door closer to operate in the closing direction and to engage the abutment with the shoulder. The interconnection between the closer and the door is then, in effect, a solid one, and the panel is closed, as customary. The door panel when in some intermediate position may swing at random due to drafts and the like. The arrangement may therefore include a friction brake to restrain random movement of the door panel in intermediate positions.

DETAILED DESCRIPTION

Figure 1:
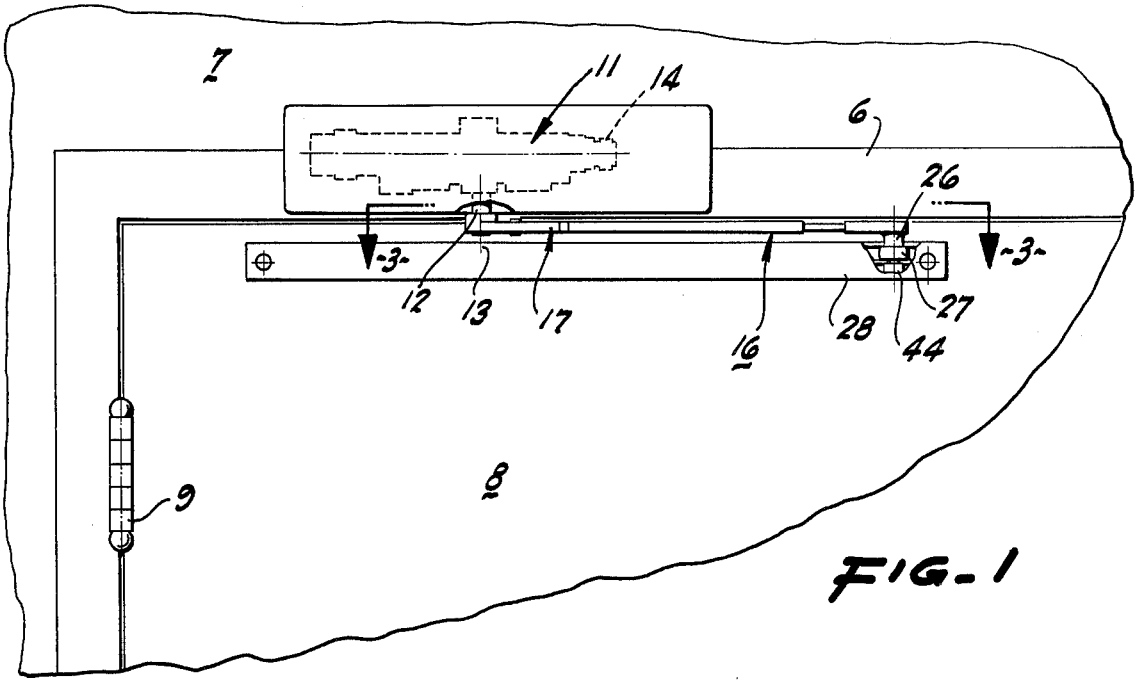
FIG. 1 is an elevation of portions of a door panel and frame with the arrangement of the invention incorporated therewith.
Figure 2:
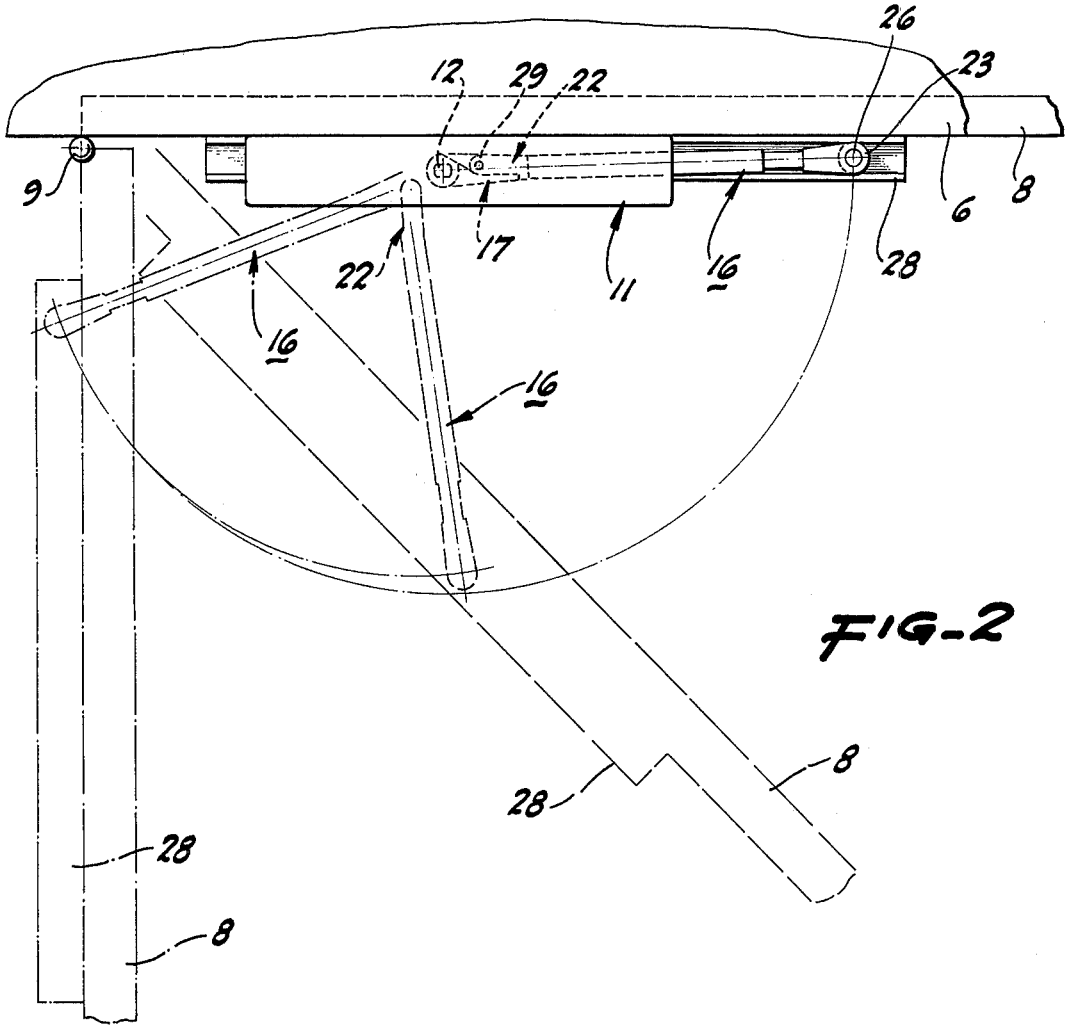
FIG. 2 is a plan of the structure of FIG. 1 showing the door closer arm in various positions.

In an exemplary installation for the present door closer arm, there is afforded a door frame 6 of the customary sort usually disposed in a wall 7 and having an opening in which a door panel 8 is disposed, the panel preferably being mounted by hinges 9 for free-swinging movement toward and away from the frame 6.

It is customary practice to provide a door closer 11 to insure that the door panel is automatically swung closed after a manual opening movement. The door closer 11 can be mounted on the door panel 8 or on the frame 6, in either instance being appropriately connected to the other of the members. In this instance the closer 11 is mounted on the frame 6.

The closer, sometimes referred to as a door closer and door check, is of well-known construction, usually incorporating a projecting shaft 12 rotatable about a vertical axis 13 and including a closure spring (not shown) tending to rotate the shaft 12 in a door closing direction. To restrain the operation of the spring, in part, the closer 11 usually accommodates a hydraulic flow mechanism with some throttling action. Additionally, and particularly in this instance, the closer 11 also includes a hold-open device 14 of the sort shown in the Martin U.S. Pat. No. 3,696,462. The hold-open device 14 interferes with free hydraulic flow within the closer 11 when the closer is in door-open position, the hold-open device 14 usually being under a remote electrical control. When the panel 8 is in open position and is held in such position by the operation of the hold-open device 14, the hold-open restraint can be remotely released by operation of the electric control. When that occurs there is no longer any restraint upon the hydraulic mechanism, and the propulsion spring is fully effective to rotate the shaft 12 toward door-closing position, thus to swing the panel 8 fully closed.

Since there are installations in which the hold-open operation of the door panel is not always desired but in which no interference with the hold-open mechanism 14 itself is desirable, we have provided a special mechanism for relating the door closer 11 to the relatively movable member, in this instance to the door panel 8.

Correspondingly, we have provided on the shaft 12 an arm generally designated 16 which serves to interconnect the shaft 12 with the relatively moving panel 8. The arm 16 is made up of several parts, particularly including an arm base 17 having a hub 18 designed to encompass the shaft 12 and held against rotation with respect thereto, not only by a noncircular connection 19 therewith but also by a restraining screw 21. With this arrangement the shaft 12 and the arm base 17 always move together. The arm base is augmented by an arm extension 22 generally included in the arm 16, and the extension 22 terminates in a boss 23. In some instances the boss 23 is pivotally connected to another link, itself connected to the door panel 8. This standard style of arm installation is not illustrated herein, as it is well understood. Another form of interconnection is provided herein. The boss 23 carries a shaft 26 having a roller 27 thereon operable in a generally straight channel 28 or track disposed on the door panel 8. It is understood that the track 28 and the closer 11 can be reversed in their mounting location, but their interactions are the same in either instance. The roller 27 is freely movable longitudinally in the track or channel 28.

To interrelate the arm base 17 and the arm extension 22 and to permit of the free-swinging operation desired in the present instance, the arm base and arm extension are interrelated by a pivot pin 29 extending along another axis 31 radially spaced from but parallel to the axis 13. To accommodate the pivot 29, the arm base 17 preferably has a cutaway portion 32, whereas the arm extension has a cutaway portion 13 overlapping the portion 32, so that the total thickness of the arm 16 in this area is not substantially greater than that of the remaining portion of the arm 16.

Figure 3:
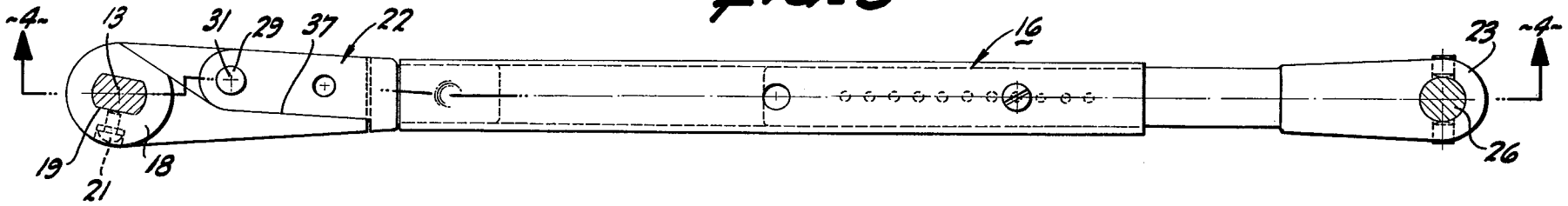
FIG. 3 is a cross-section, the plane of which is indicated by the line 3—3 of FIG. 1.
Figure 4:
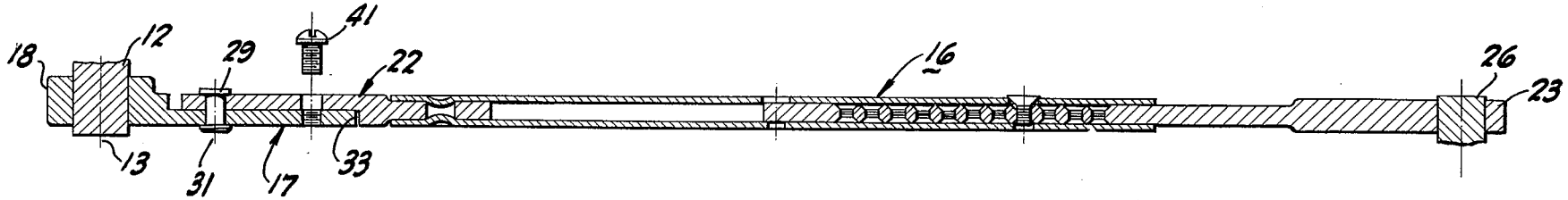
FIG. 4 is a cross-section, the plane of which is indicated by the line 4—4 of FIG. 3.
Figure 5:
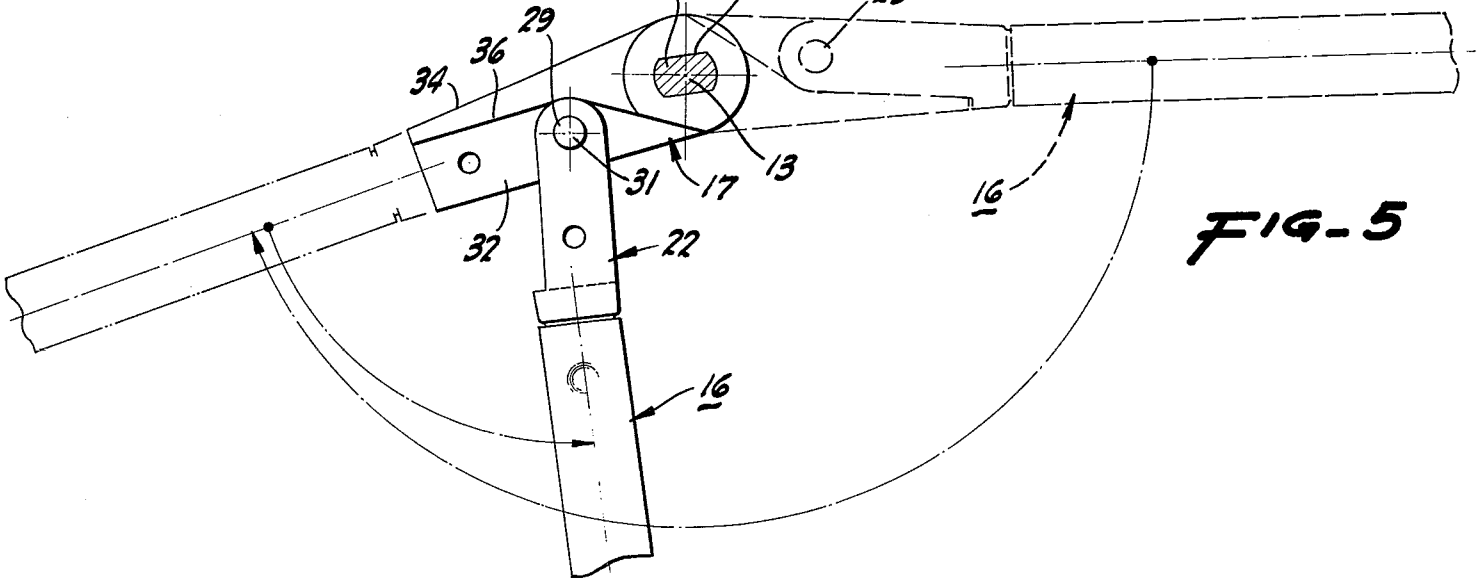
FIG. 5 is a plan showing portions of the closer arm in different relative positions about the first axis and the second axis.

To limit the relative rotation of the arm extension and the arm base about the axis 31 of the pivot 29, the base 17 is contoured to provide a shoulder 34 on the arm base including a substantially radially extending wall 36 and an abutment 37 on the arm extension which likewise, in one position of the parts, extends substantially radially. As shown in FIG. 3, in one extreme position the abutment 37 and the shoulder 34 are in contact with each other and preclude any relative motion of the arm base and arm extension about the pivot 29 in one direction, although allowing free relative rotation in the other direction.

While the device as so far described is entirely adequate for the main purpose, under other circumstances the operation of the pivot 29 is not desired. When desired, the parts can be locked together by means of a separate screw 41 which can be passed through the arm extension and threaded into the arm base, thus precluding relative rotation therebetween about the pivot 29.

When the screw 41 is absent, the arrangement affords free relative rotation between the arm parts. Even so, sometimes it is desired to have an inhibiting action about the axis of the pivot 29 to preclude random swinging of the door panel. For this reason there is afforded a on damping device, preferably in the nature of a friction brake. The brake can be applied in the vicinity of the pivot 29, but it is sometimes easier to mount on the shaft 26 a friction brake shoe 44 (FIG. 1) adapted to engage with the channel 28 and to afford a limited restraint on the movement of the arm extension 16 and so afford a comparable restraint of pivotal motion about the pivot 29.

With a device of the sort described fully installed, when the door panel 8 is manually moved into an open position the spring in the closer 11 is in its energized position. When the hold-open device 14 is likewise energized, the hold-open device is firmly fixed in its open position. But a person manually pushing the door panel 8 toward closed position is not restrained in doing so since the roller 27 easily travels in the channel 28 because the arm extension 22 is freely pivotable in a corresponding direction, not about the axis 13, but about the pivot 29, the abutment 37 leaving the shoulder 34 to any desired extent. In any intermediate position, the door panel is not subject to random motion which might otherwise be induced by wind or the like because the friction shoe 44 affords some braking restraint.

A person can manually move the panel 8 toward closed position or toward open position and can leave such panel in any intermediate location. If the door panel should be at least partly closed and the hold-open device 14 is then released, either locally or remotely, there is no longer any hydraulic restraint on the closer 11. The energized spring rotates the shaft 12, which concomitantly rotates the arm base 17 in the closing direction. After moving through whatever angle is necessary for the shoulder 34 again to contact the abutment 37, the arm 16 is in effect one piece and swings as a unit about the first axis 13 with the roller 27 travelling in the channel 28 until such time as the door panel 8 is completely closed.

With this device, when the locking screw 41 is positioned the arm serves as a solid member in the customary fashion. However, when the screw 41 is removed, the arm in effect acts as a toggle or knuckle in one direction of rotation and permits the manual motion of the door panel when the hold-open is effective. The overriding closing function always is effective to close the panel from whatever intermediate position it may occupy whenever the hold-open mechanism 14 is no longer effective.

We claim:

1. An arm for a door closer having a shaft adapted to rotate about a first axis comprising an arm base, means on said base engageable with said shaft for rotation therewith, an arm extension, means on said extension for engagement with a restraining device, means for connecting said arm extension and said arm base to each other for rotation relative to each other about a second axis, and means for limiting said relative rotation.

2. A device as in claim 1 in which said limiting means includes a shoulder on said arm base and an abutment on said arm extension.

3. A device as in claim 1 including means for locking said arm base and said arm extension against relative rotation about said second axis.

4. A device as in claim 1 in which said first axis and said second axis are parallel to each other.

5. A device as in claim 1 in which said means for limiting said relative rotation is effective in only one direction of said relative rotation.

6. A device as in claim 1 including means for damping said relative rotation.

7. A device as in claim 6 in which said damping means includes a friction brake.

8. A device as in claim 1 including means on said arm extension for engagement with a restraining device and in which said means for limiting relative rotation is effective when said first axis, said second axis, and said means for engagement are all substantially in the same straight line.

9. For use with a door closer having a shaft rotatable about a first axis, an arm base including a hub nonrotatably engageable with said shaft, an arm extension, means on said arm extension for connecting said arm extension to a mounting, a pivot engaging said arm base and said arm extension and disposed on a second axis separate from said first axis, and means for limiting relative movement of said arm base and said arm extension about said second axis.

10. In combination, an arm base having a non-circular hole therein, a pivot on said arm base, an arm extension engaging said pivot, means for connecting said arm extension to a mounting, and means for limiting relative movement of said arm base and said arm extension about said pivot.

* * * * *